US009889486B2

(12) United States Patent
Sakamoto et al.

(10) Patent No.: US 9,889,486 B2
(45) Date of Patent: Feb. 13, 2018

(54) MANUFACTURING METHOD OF PRESS-FORMED ARTICLE AND PRESS FORMING APPARATUS

(71) Applicant: Kobe Steel, Ltd., Hyogo (JP)

(72) Inventors: Kazuki Sakamoto, Kobe (JP); Yasuhiro Hayashida, Kobe (JP); Kenichi Watanabe, Kobe (JP); Junya Naitou, Kobe (JP); Kensuke Funada, Kobe (JP); Takayuki Kimura, Kobe (JP); Jiro Iwaya, Nagoya (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/298,405

(22) Filed: Oct. 20, 2016

(65) Prior Publication Data

US 2017/0136514 A1 May 18, 2017

(30) Foreign Application Priority Data

Nov. 18, 2015 (JP) ..... 2015-225996

(51) Int. Cl.

| | |
|---|---|
| ***B21D 22/02*** | (2006.01) |
| ***B21D 28/00*** | (2006.01) |
| ***B21D 35/00*** | (2006.01) |
| ***B21D 49/00*** | (2006.01) |
| ***B21J 5/08*** | (2006.01) |

(52) U.S. Cl.

CPC ..... *B21D 22/022* (2013.01); *B21D 22/02* (2013.01); *B21D 28/00* (2013.01); *B21D 35/006* (2013.01); *B21D 49/00* (2013.01); *B21J 5/08* (2013.01)

(58) Field of Classification Search

CPC ..... B21J 5/02; B21J 5/025; B21J 5/08; B21D 22/02; B21D 35/006; B21C 37/02

USPC ..... 72/353.2, 354.2, 355.2

See application file for complete search history.

(56) References Cited

U.S. PATENT DOCUMENTS 4,305,273 A * 12/1981 Martin ..... B21J 5/02 72/342.3
5,195,349 A * 3/1993 Ishinaga ..... B21J 5/02 72/355.2
2004/0216505 A1 11/2004 Knaup (Continued)

FOREIGN PATENT DOCUMENTS

| | | |
|---|---|---|
| JP | 2007-014978 A | 1/2007 |
| JP | 2008-296252 | 12/2008 |
| JP | 2014-166645 A | 9/2014 |

*Primary Examiner* — Debra Sullivan

(74) *Attorney, Agent, or Firm* — Studebaker & Brackett PC

(57) ABSTRACT

A manufacturing method of press-formed article according to the present invention includes a step of placing a flat plate member between a first die and a second die, and a step of causing a first press portion and a second press portion approach each other, thereby pressing the flat plate member. In the step of placing, the flat plate member is placed so that a first main surface and a second main surface align with a vertical direction. In the step of pressing, the flat plate member is vertically pressed by causing the first press portion and the second press portion to approach each other in the vertical direction, and a thick portion is formed on the flat plate member by causing a part of a material of the flat plate member in the vertical direction to flow into a thickened portion-forming section formed on a first opposing surface.

10 Claims, 12 Drawing Sheets

(56) References Cited

U.S. PATENT DOCUMENTS

| | | | |
|---|---|---|---|
| 2008/0299352 | A1 | 12/2008 | Matsuda et al. |
| 2013/0061647 | A1 | 3/2013 | Matsuda et al. |

* cited by examiner

MANUFACTURING METHOD OF PRESS-FORMED ARTICLE AND PRESS FORMING APPARATUS

BACKGROUND OF THE INVENTION

Field of the Invention

The present invention relates to a manufacturing method of press-formed article and a press forming apparatus.

Description of the Related Art

Hitherto, there is known a technology of manufacturing a metal plate used for a frame component of a vehicle such as a motor vehicle by means of the press forming. In this application, a need for a metal plate constant in the plate thickness as well as a metal plate having a difference in the plate thickness by partially forming a thickened portion is increasing. JP 2014-166645A, JP 2007-14978A, and JP 2008-296252A disclose apparatuses and methods for manufacturing a metal plate on which a thickened portion is formed by means of the press forming.

In the press forming apparatuses disclosed in JP 2014-166645A and JP 2007-14978A, a metal plate is arranged between a pair of upper and lower dies, and the metal plate is pressed in a direction parallel with a main surface in this state. As a result, a part of a material of the metal plate becomes fluid, flows into a recess provided in the die, and a thickened portion in a shape corresponding to a shape of the recess is formed. Moreover, according to JP 2008-296252A, protrusions are partially provided in a lengthwise direction in a metal plate bent in a U shape, and a thickened portion is partially formed in the lengthwise direction by pressing the protrusions in a horizontal direction.

According to JP 2014-166645A and JP 2007-14978A, upper and lower dies are arranged so that opposing surfaces opposing main surfaces of a metal plate align with the horizontal direction, and both ends of the metal plate are pressed in the horizontal direction. These press forming apparatuses placed in the horizontal direction require a wide space for placing the dies, and possesses such a problem that space saving is difficult.

Moreover, according to JP 2008-296252A, a top die is moved downward, thereby bringing the top die in contact with a pair of lower lateral dies, and the metal plate is pressed by moving the pair of lateral dies in the horizontal direction so as to approach each other. In other words, there is provided such a structure that a driving force for moving the top die in the vertical direction is converted into driving forces for moving the lateral dies in the horizontal direction, and a special die structure and a gimmick are thus necessary. As a result, the die structure becomes complex, which possesses a problem of an increased cost.

SUMMARY OF THE INVENTION

The present invention is made in view of the above-mentioned problem, and has an object to provide a manufacturing method of press-formed article and a press forming apparatus enabling a decrease in the complexity of the die structure, thereby decreasing the cost as well as the space.

(1) A manufacturing method of press-formed article according to one aspect of the present invention is a manufacturing method of press-formed article by forming a flat plate member. The method includes a step of placing the flat plate member between a first die and a second die so that a first main surface of the flat plate member opposes a first opposing surface, and a second main surface, which is a main surface directing opposite to the first main surface of the flat plate member, opposes a second opposing surface, and a step of causing a first press portion opposing a first end of the flat plate member and a second press portion opposing a second end on an opposite side of the first end of the flat plate member to approach each other, thereby pressing the flat plate member. In the step of the placing the flat plate member, the flat plate member is placed so that the first main surface and the second main surface align with a vertical direction. In the step of pressing, the flat plate member is pressed in the vertical direction by causing the first press portion and the second press portion to approach each other in the vertical direction. Moreover, in the step of pressing, a thick portion is formed on the flat plate member by causing a part of a material of the flat plate member in the vertical direction to flow into a thickened portion-forming section formed at least one of the first opposing surface and the second opposing surface.

In the above-mentioned method, the flat plate member is pressed by the first press portion and the second press portion, and the thickened portion, which is a thick portion, is formed on the flat plate member by causing a part of the material of the flat plate member in the vertical direction to flow into the thickened portion-forming section. Moreover, the flat plate member is arranged in a vertically placed state so that the first main surface and the second main surface align with the vertical direction, the dies can be placed in a narrow space compared with the conventional case where the flat plate member is placed in a horizontally placed state so that the first main surface and the second main surface align with the horizontal direction, resulting in a saved space. Moreover, both the direction in which the first press portion and the second press portion approach each other, and the direction in which the flat plate member is pressed are the same vertical direction. Thus, a driving force for causing the first press portion and the second press portion to approach each other can be directly used as a force for pressing the flat plate member, the conventional special die structure and the gimmick are thus no longer necessary, and the die structure can be simplified, thereby decreasing the cost.

On this occasion, "the first end and the second end" mean ends on both sides in the press direction of the flat plate member.

(2) In the above-mentioned manufacturing method of press-formed article, at least one of the first die and the second die may be arranged so that the bottom end is positioned in a recess formed on a mount surface of a support member.

As a result, positioning can be promoted by positioning the bottom end of the die is in the recess.

(3) In the above-mentioned manufacturing method of press-formed article, the first die and the second die may be arranged so as to be positioned between portions of a supporting member in the step of pressing.

As a result, even if the dies are vertically placed, the dies can be prevented from falling down in the press step.

(4) In the above-mentioned manufacturing method of press-formed article, the step of placing the flat plate member may include a first placing step of placing the flat plate member so that the first main surface opposes the first opposing surface, and a second placing step of placing the second die so that the second main surface opposes the second opposing surface after the first placing step. The flat plate member may be supported by a temporarily supporting member so that the first main surface and the second main surface align with the vertical direction in the first placing step.

As a result, even before the flat plate member is arranged between the first die and the second die, the flat plate member can be stably supported so as not to fall down.

(5) In the above-mentioned manufacturing method of press-formed article, the flat plate member may be formed by means of hot press.

In the above-mentioned method, the thickened portion can easily be formed even in the case of the hot press by controlling the fluid so that a part of the material of the flat plate member flows into the thickened portion-forming section.

(6) A press forming apparatus according to another aspect of the present invention is a press forming apparatus for forming a flat plate member. The press forming apparatus includes a first press portion that opposes a first end of the flat plate member, a second press portion that opposes a second end, which is an end on an opposite side with respect to the first end of the flat plate member, a first die that includes a first opposing surface opposing a first main surface of the flat plate member, a second die that includes a second opposing surface opposing a second main surface, which is a main surface directing opposite to the first main surface of the flat plate member, and a driving section that causes the first press portion and the second press portion to approach each other in a vertical direction so as to press the flat plate member. A thickened portion-forming section is formed on at least one of the first opposing surface and the second opposing surface so that a part of a material of the flat plate member flows into the thickened portion-forming section, thereby forming a thick portion on the flat plate member. The first die and the second die are respectively arranged so that the first opposing surface and the second opposing surface align with the vertical direction.

In the above-mentioned press forming apparatus, the flat plate member is pressed by the first press portion and the second press portion, and the thickened portion, which is a thick portion, is formed on the flat plate member by causing a part of the material of the flat plate member in the vertical direction to flow into the thickened portion-forming section. Moreover, the first die and the second die are arranged in the vertically placed state where the first opposing surface and the second opposing surface align with the vertical direction, and the dies can thus be placed in a narrow space compared with the conventional case where the first opposing surface and the second opposing surface are arranged in a horizontally placed state so as to align with the horizontal direction, resulting in a saved space. Moreover, both the direction in which the first press portion and the second press portion approach each other, and the direction in which the flat plate member is pressed are the same vertical direction. Thus, a driving force for causing the first press portion and the second press portion to approach each other is directly used as a force for pressing the flat plate member, the conventional special die structure and the gimmick are thus no longer necessary, and the die structure can be simplified, thereby decreasing the cost.

(7) The above-mentioned press forming apparatus may include a support member that includes a mount surface on which the first die and the second die are placed. A recess in which a bottom end of at least one of the first die and the second die is positioned may be formed on the mount surface.

As a result, positioning can be promoted by positioning the bottom end of the die is in the recess.

(8) In the above-mentioned press forming apparatus, the first die may have a first side surface directing opposite to the first opposing surface. The second die may have a second side surface directing opposite to the second opposing surface. The above-mentioned press forming apparatus may include a supporting member that has portions positioned outside in the horizontal direction of the first side surface and the second side surface.

As a result, even if the dies are vertically placed, the dies can be prevented from falling down during the pressing.

(9) The above-mentioned press forming apparatus may include a press member on which the first press portion is provided. The press member may be integrally formed with the supporting member.

As a result, the structure of the press forming apparatus can be more simplified compared with a case where the press member and the supporting member are constructed independently of each other.

(10) The above-mentioned press forming apparatus may comprise a temporarily supporting member that is attached to the support member, and supports the flat plate member so that the first main surface and the second main surface are aligned with the vertical direction.

As a result, even before the flat plate member is arranged between the first die and the second die, the flat plate member can be stably supported so as not to fall down.

With the above-mentioned press forming apparatus, the thickened portion can easily be formed even in the case of the hot press by controlling the fluid so that a part of the material of the flat plate member flows into the thickened portion-forming section.

EFFECTS OF INVENTION

The present invention can provide the manufacturing method of press-formed article and the press forming apparatus enabling a decrease in the complexity of the die structure, thereby decreasing the cost as well as the space.

DESCRIPTION OF THE PREFERRED EMBODIMENTS

Hereinafter, embodiments of the present invention will be described in detail with reference to drawings.

First Embodiment

[Configuration of Press Forming Apparatus]

Figure 1:
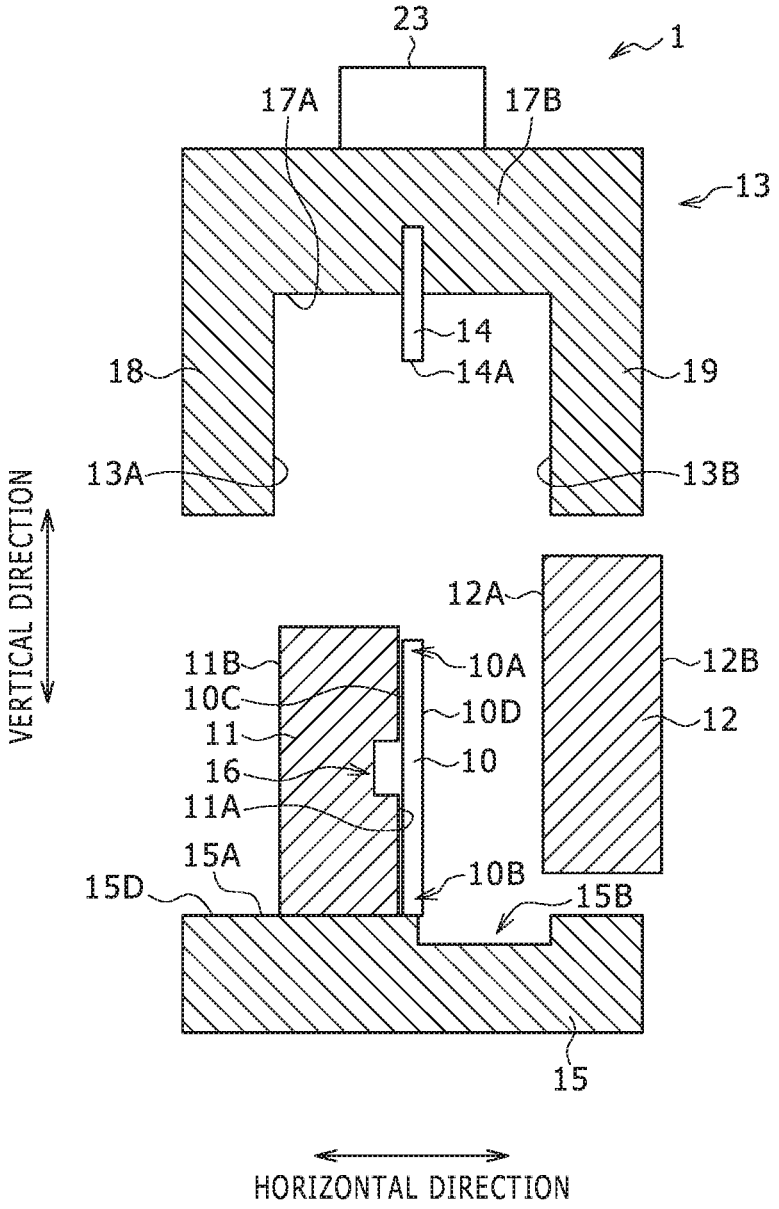
FIG. 1 is a diagram showing a configuration of a press forming apparatus according to a first embodiment of the present invention.
Figure 3:
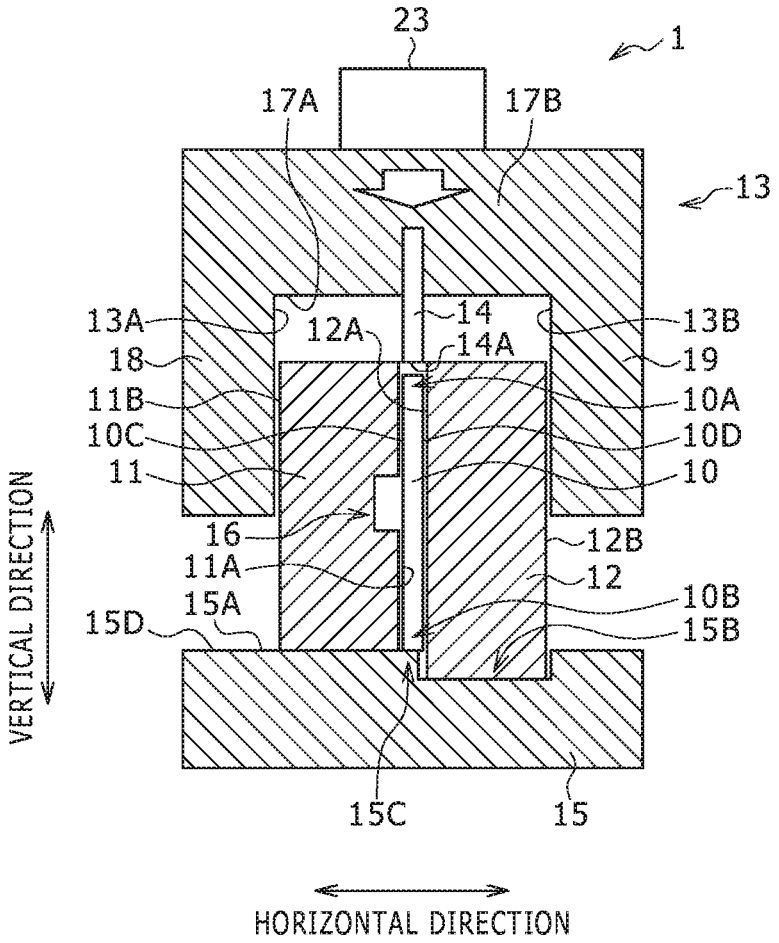
FIG. 3 is a diagram describing the manufacturing method of press-formed article.
Figure 4:
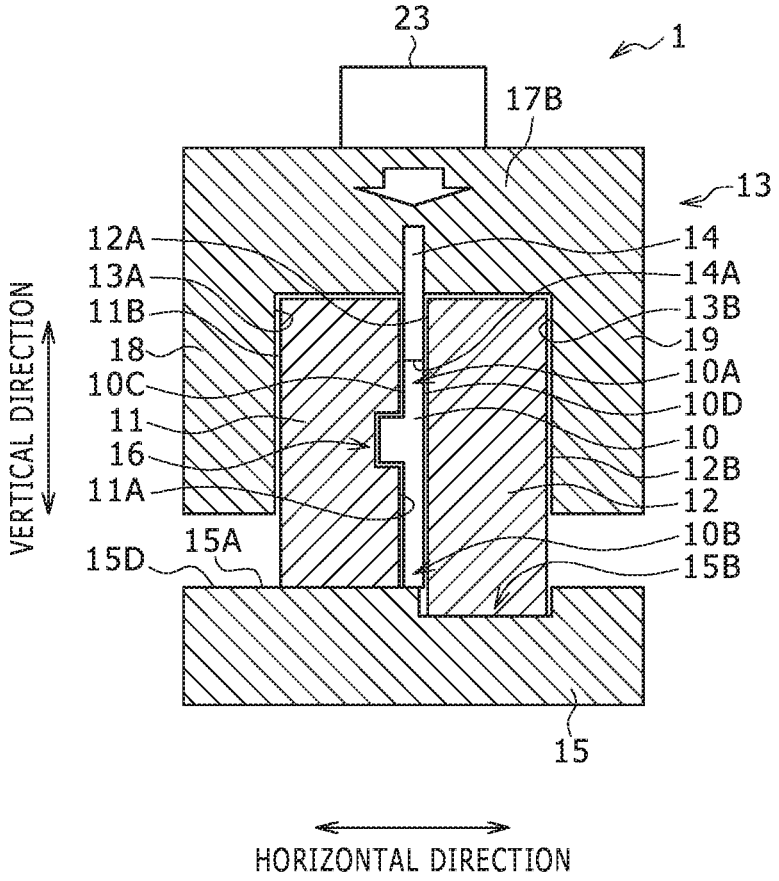
FIG. 4 is a diagram describing the manufacturing method of press-formed article.

First, a description is given of a configuration of a press forming apparatus 1 according to a first embodiment of the present invention with reference to FIGS. 1, 3, and 4.

The press forming apparatus 1 is an apparatus that carries out press forming so that a partially thick portion (thickened portion) is formed on a flat plate member 10 such as a metal plate constant in a plate thickness. The press forming apparatus 1 includes a first die 11, a second die 12, a support member 15, a supporting member 13, a press member 14, and a driving section 23. The flat plate member 10 is a metal plate made of a material such as hard steel, soft steel, or aluminum, and includes a first main surface 10C, a second main surface 10D, which is a main surface opposing the first main surface 10C, a first end 10A, and a second end 10B, which is an end on an opposite side of the first end 10A.

The first die 11 is in an approximately rectangular parallelepiped shape, and includes a first opposing surface 11A opposing the first main surface 10C of the flat plate member 10, and a first side surface 11B directing opposite to the first opposing surface 11A in the horizontal direction. The first die 11 is placed on its bottom surface on a support member 15, and is arranged so that the first opposing surface 11A aligns with the vertical direction (is parallel with the vertical direction) as illustrated in FIGS. 1, 3, and 4.

A thickened portion-forming section 16 in a recessed groove shape is formed at a portion approximately at the center in the vertical direction on the first opposing surface 11A. The thickened portion-forming section 16 is provided so that a part of the material of the flat plate member 10 in the vertical direction flows into the thickened portion-forming section 16 during the press forming, thereby forming a thickened portion, which is a thick portion on the flat plate member 10. The thickened portion-forming section 16 is a portion surrounded by a pair of sidewall surfaces formed by horizontal surfaces extending in the horizontal direction, a flat bottom wall surface connecting ends on an inner side of the pair of the side wall surfaces with each other, and is recessed toward a direction departing from the flat plate member 10.

It should be noted that the shape of the thickened portion-forming section 16 is not limited to this shape, and can be appropriately changed depending on the shape of the thickened portion formed on the flat plate member 10. For example, the cross sectional shape may be semicircular or triangular. Moreover, multiple thickened portion-forming sections 16 may be formed on the first opposing surface 11A. Moreover, the position at which the thickened portion-forming section 16 is formed is not limited to the center of the first opposing surface 11A, and may be formed on an end side.

The second die 12 is in a rectangular parallelepiped shape more in the width in the vertical direction than the first die 11, and includes a second opposing surface 12A opposing the second main surface 10D of the flat plate member 10, and a second side surface 12B directing opposite to the second opposing surface 12A in the horizontal direction. As illustrated in FIG. 3, the second die 12 is arranged next to the first die 11 on the support member 15 so that the second opposing surface 12A opposes the first opposing surface 11A across the flat plate member 10, and the top surface is parallel with the top surface of the first die 11. As a result, the flat plate member 10 can be arranged between the first die 11 and the second die 12. The second die 12 is placed on its bottom surface on the support member 15 as the first die 11, and is arranged so that the second opposing surface 12A aligns with the vertical direction (is parallel with the vertical direction).

In the press forming apparatus 1 according to this embodiment, the first die 11 and the second die 12 are arranged in the vertically placed state so that the first opposing surface 11A and the second opposing surface 12A align with the vertical direction in this way. Therefore, the apparatus can be placed in a narrower space compared with a case where the first die 11 and the second die 12 are arranged in a horizontally placed state so that the first opposing surface 11A and the second opposing surface 12A align with the horizontal direction. In other words, the press forming apparatus 1 has a structure advantageous in the space saving.

The support member 15 is a metal member in a rectangular parallelepiped shape, and includes a mount surface 15A on which bottom surfaces of the first die 11 and the second die 12 are placed. The support member 15 is arranged on a bottom side in the vertical direction of the first die 11 and the second die 12 in a state where the support member 15 is in a horizontally placed state so that the mount surface 15A aligns with the horizontal direction (is parallel with the horizontal direction).

A flat surface 15D and a recess 15B recessed from the flat surface 15D are formed on the mount surface 15A. The first die 11 is placed on a portion adjacent to the recess 15B on the flat surface 15D. The recess 15B is formed in a groove shape corresponding to a shape of a bottom end of the second die 12. The recess 15B is a portion surrounded by a pair of flat side wall surfaces extending in the vertical direction and a flat bottom wall surface connecting bottom sides of the pair of the sidewall surfaces with each other. As shown in FIG. 3, the second die 12 is positioned by arranging the bottom end so as to be placed in the recess 15B (bringing the bottom end in contact with the bottom wall surface of the recess 15B). Moreover, a portion 15C adjacent to the recess 15B of the flat surface 15D opposes the second end 10B of the flat plate member 10, and functions as a second press portion for pressing the flat plate member 10 from the second end 10B side as described later.

The supporting member 13 is a member for supporting the first die 11 and the second die 12 arranged in the vertically placed state as described above so as not to fall down. The supporting member 13 includes a first supporting portion 18, a second supporting portion 19, and a main body portion 17B for connecting the supporting portions with each other, and these portions are integrally formed as shown in FIGS. 1, 3, and 4. A cross section of the supporting member 13 cut on a plane including the left/right direction and the vertical direction of FIG. 1 has a U shape inverted upside down.

The main body portion 17B extends outward with respect to the first side surface 11B and the second side surface 12B in a state where the flat plate member 10 is arranged between the first die 11 and the second die 12 (FIG. 3). The first supporting portion 18 and the second supporting portion 19 extend downward in the vertical direction from both ends in the horizontal direction of the main body portion 17B toward the support member 15. The first supporting portion 18 is positioned outside the first side surface 11B in the horizontal direction, and the second supporting portion 19 is positioned outside the second side surface 12B in the horizontal direction in a state where the supporting member 13 is moved down (FIG. 3) as shown in FIG. 3. In other words, the first supporting portion 18 is a portion that can be in contact with the first side surface 11B, and the second supporting portion 19 is a portion that can be in contact with the second side surface 12B.

A first inner surface 13A opposing the first side surface 11B is formed inside the first supporting portion 18, and a second inner surface 13B opposing the second side surface 12B is formed inside the second supporting portion 19. On this occasion, a horizontal distance between the first inner surface 13A and the second inner surface 13B is slightly longer than a horizontal distance between the first side surface 11B and the second side surface 12B. As a result, the first die 11 and the second die 12 can be placed between the first supporting portion 18 and the second supporting portion 19 as shown in FIG. 3.

The press member 14 is a member for pressing the flat plate member 10. The press member 14 is provided, at a tip, with a first press portion 14A opposing the first end 10A of the flat plate member 10, and is attached to a portion approximately the center in the horizontal direction of the main body portion 17B. More specifically, the press member 14 is integrally formed with the supporting member 13 so that the first press portion 14A is positioned on a lower side in the vertical direction with respect to the bottom surface 17A of the main body portion 17B.

The driving section 23 is a unit for moving the press member 14 in the vertical direction. The driving section 23 includes a reciprocally movable hydraulic or electric piston, and is arranged on a top surface of the supporting member 13 (main body portion 17B). According to this embodiment, the press member 14 is fixed to the supporting member 13, and the press member 14 can thus indirectly be moved by the driving section 23 pressing the supporting member 13. As a result, the first press portion 14A can be caused to approach the second press portion 15A, and the flat plate member 10 can be pressed in the direction parallel with the main surfaces 10C and 10D by the first press portion 14A and the second press portion 15A. It should be noted that the press member 14 and the supporting member 13 may be provided independently of each other, and, in this case, the driving section 23 may be configured to move only the press member 14.

The first press portion 14A and the second press portion 15A can be caused to approach each other in the vertical direction in this way, thereby pressing the flat plate member 10 in the vertical direction in the press forming apparatus 1 according to this embodiment. In other words, both the direction in which the first press portion 14A and the second press portion 15A are caused to approach each other and the direction in which the flat plate member 10 is pressed are the vertical direction, and are thus the same with each other. Therefore, a driving force by the driving section 23 for causing the first and second press portions 14A and 15A approach each other can be directly used as a force for pressing the flat plate member 10. Therefore, a special die structure and a gimmick are not necessary for changing the driving force in the vertical direction of the driving section 23 to a different direction, and the structure of the first and second dies 11 and 12 can thus be simplified.

[Manufacturing Method of Press-Formed Article]

Figure 2:
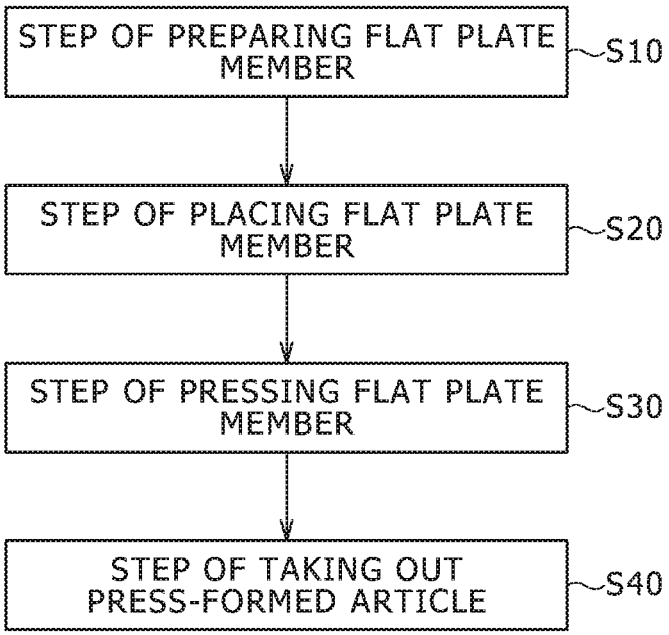
FIG. 2 is a flowchart showing procedures of a manufacturing method of press-formed article according to the first embodiment of the present invention.

A description is now given of a manufacturing method of press-formed article according to this embodiment by using the press forming apparatus 1 with reference to a flowchart shown in FIG. 2. First, a step S10 of preparing for the flat plate member 10 is carried out. In the step S10, a metal plate constant in the plate thickness is prepared as the flat plate member 10, and the flat plate member 10 is heated at a predetermined temperature in an electric furnace or the like. As a result, the entire flat plate member 10 is brought into a softened state. The press-formed article is manufacturing method by means of the hot press of applying press forming to the flat plate member 10 in the softened state by the heating in this way according to this embodiment. It should be noted that the present invention is not limited to the case of the hot press, and the step S10 may be omitted in a case of the cold working.

Then, a step S20 of placing the flat plate member 10 is carried out. In the step S20, a first placement step S21 and a second placement step S22 described later are sequentially carried out, thereby placing the flat plate member 10 between the first die 11 and the second die 12 while the first main surface 10C and the second main surface 10D align with the vertical direction (are parallel with the vertical direction) as shown in FIG. 3.

First, the flat plate member 10 is placed so that second end 10B is in contact with the mount surface 15A, and the first main surface 10C opposes the first opposing surface 11A in a state where the first die 11 is placed on the mount surface 15A so that the first opposing surface 11A aligns with the vertical direction in the first placement step S21 as shown in FIG. 1. Then, the second die 12 is placed on the support member 15 so that the bottom end is placed in the recess 15B in the second placement step S22 as shown in FIG. 3. As a result, a state where the second main surface 10D is opposing the second opposing surface 12A is brought about, and the flat plate member 10 is arranged between the first die 11 and the second die 12 in the state where the first main surface 10C and the second main surface 10D are aligned with the vertical direction.

Then, a step S30 of pressing the flat plate member 10 is carried out. The press member 14 is moved down toward the support member 15 by operating the driving section 23 while the flat plate member 10 is arranged between the first die 11 and the second die 12 as shown in FIG. 3 in the step S30 (arrow in FIG. 3). As a result, the first press portion 14A approaches the second press portion 15A, and comes in contact with the first end 10A of the flat plate member 10. Then, the flat plate member 10 is pressed by the first press portion 14A and the second press portion 15A from the both ends 10A and 10B in the direction parallel with the main surfaces 10C and 10D by further moving down the press member 14 as shown in FIG. 4.

The first press portion 14A and the second press portion 15A can be caused to approach each other in the vertical direction in this way, thereby pressing the flat plate member 10 in the vertical direction by the driving section 23 according to this embodiment. As a result, a fluid of the material is generated in the direction parallel with the main surfaces 10C and 10D in the softened flat plate member 10, and a part of the material flows into the thickened portion-forming section 16. As a result, a thickened portion, which is a thick portion, is formed on a first main surface 10C side of the flat plate member 10.

Moreover, the supporting member 13 moves down toward the support member 15 along with the press member 14 in the step S30, the flat plate member 10 can be pressed in a state where the first and second dies 11 and 12 are placed between the portions of the supporting member 13 as shown in FIG. 4. As a result, the first die 11 and the second die 12 can be prevented from falling down by an impact during the press.

Finally, a step S40 of taking out the press-formed article is carried out. After the forming of the flat plate member 10 is completed in the step S30, the press member 14 is moved up by operating the driving section 23 in the step S40. Then, the second die 12 is removed from the support member 15, and the press-formed article is removed from the first die 11. The manufacturing method of press-formed article according to this embodiment is completed by the steps S10 to S40.

Operations and Effects

A description is now given of features and operations/effects of the press forming apparatus 1 according to the embodiment.

The press forming apparatus 1 includes the first press portion 14A, the second press portion 15A, the first die 11 including the first opposing surface 11A, the second die 12 including the second opposing surface 12A, and the driving section 23 for causing the first press portion 14A and the second press portion 15A to approach each other. The thickened portion-forming section 16 for forming the thick portion on the flat plate member 10 is formed on the first opposing surface 11A. The first die 11 and the second die 12 are respectively arranged so that the first opposing surface 11A and the second opposing surface 12A align with the vertical direction. The press forming apparatus 1 is configured so that a part of the material of the flat plate member 10 in the vertical direction flows into the thickened portion-forming section 16 by causing the first press portion 14A and the second press portion 15A to approach each other in the vertical direction, thereby pressing the flat plate member 10 in the vertical direction.

In the above-mentioned press forming apparatus 1, the flat plate member 10 is pressed by the first press portion 14A and the second press portion 15A, and the thickened portion, which is the thick portion, is formed on the flat plate member 10 by causing a part of the material of the flat plate member 10 in the vertical direction to flow into the thickened portion-forming section 16. Moreover, the first die 11 and the second die 12 are arranged in the vertically placed state where the first opposing surface 11A and the second opposing surface 12A align with the vertical direction, and the dies can thus be placed in a narrow space compared with the conventional case where the first opposing surface 11A and the second opposing surface 12A are arranged in the horizontally placed state so as to align with the horizontal direction, resulting in a saved space. Moreover, both the direction in which the first press portion 14A and the second press portion 15A approach each other, and the direction in which the flat plate member 10 is pressed are the same vertical direction. Thus, the driving force of the driving section 23 for causing the first press portion 14A and the second press portion 15A to approach each other is directly used as the force for pressing the flat plate member 10, the conventional special die structure and the gimmick are thus no longer necessary, and the die structure can be simplified, thereby decreasing the cost.

The press forming apparatus 1 includes the support member 15 including the mount surface 15A on which the first die 11 and the second die 12 are placed. The recess 15B in which the bottom end of the second die 12 is positioned is formed on the mount surface 15A. As a result, the second die 12 can easily be positioned by positioning the bottom end of the second die 12 in the recess 15B as shown in FIG. 3.

The press forming apparatus 1 includes the supporting member 13 including the first and second supporting portions 18 and 19 positioned outside, in the horizontal direction, the first side surface 11B and the second side surface 12B. As a result, even if the first die 11 and the second die 12 are vertically placed, the first die 11 and the second die 12 can be prevented from falling down during the press forming.

The press forming apparatus 1 includes the press member 14 on which the first press portion 14A is provided, and the press member 14 is integrally formed with the supporting member 13. As a result, the structure of the press forming apparatus 1 can be more simplified compared with the case where the press member 14 and the supporting member 13 are constructed independently of each other.

Second Embodiment

A description is now given of a press forming apparatus 2 and a manufacturing method of press-formed article according to a second embodiment of the present invention. The press forming apparatus 2 according to the second embodiment basically has the same configuration as that of the press forming apparatus 1 according to the first embodiment, and provides the same effect, but is different in a point that the press forming apparatus 2 further includes temporarily supporting members 21 for supporting the flat plate member 10.

Figure 5A:
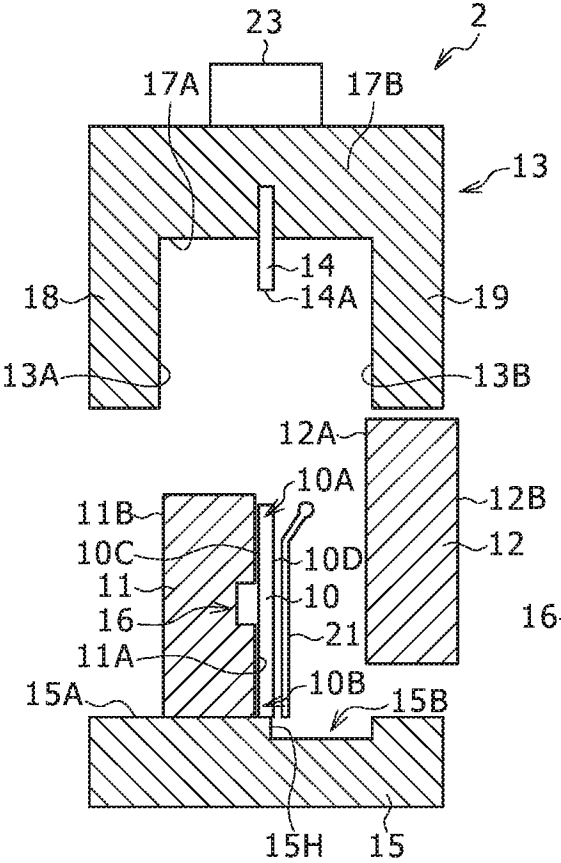
FIGS. 5A and 5B are diagrams showing the configuration of a press forming apparatus according to a second embodiment of the present invention.
Figure 5B:
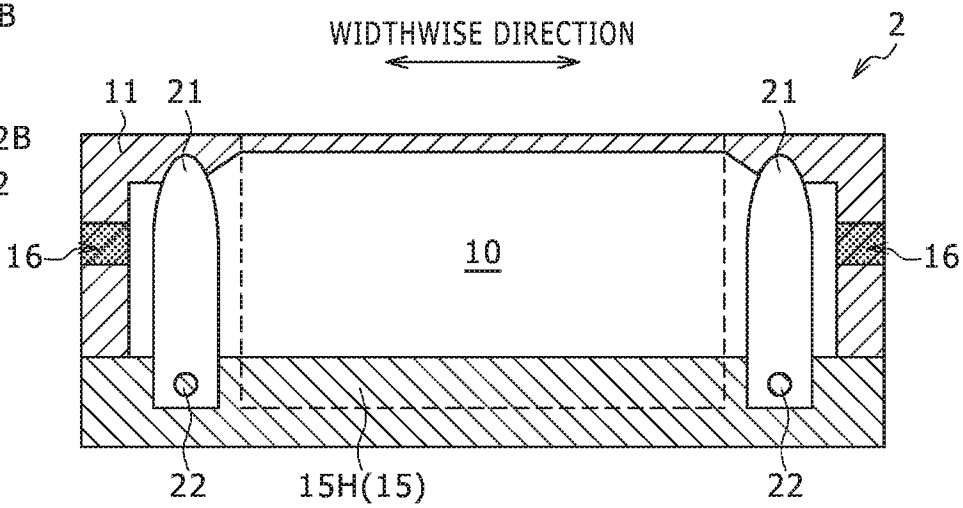

The press forming apparatus 2 includes the pair of temporarily supporting members 21 each in a thin plate shape as shown in FIGS. 5A and 5B. The temporarily supporting members 21 are attached outside, in the widthwise direction, an arrangement area (portion indicated by broken lines) of the second die 12 as illustrated in FIG. 5B. It should be noted that a state before the temporarily supporting members 21 are attached to the support member 15 is shown in FIG. 5A.

The temporarily supporting members 21 have an elongate shape extending from a bottom end to a top end, the top end is bent so as to depart from the flat plate member 10, and the bottom end is fixed by a fixing tool 22 to a side wall surface 15H on the first die 11 side of the recess 15B. The temporarily supporting members 21 are in contact with the second main surface 10D on both ends of the flat plate member 10, thereby supporting the flat plate member 10 so that the state where the first main surface 10C and the second main surface 10D align with the vertical direction is maintained.

The flat plate member 10 is first arranged between the first die 11 and the temporarily supporting members 21 in the first placement step S21 of the manufacturing method using the press forming apparatus 2. On this occasion, the flat plate member 10 is supported by the contact of the second main surface 10D with the temporarily supporting members 21, and the first main surface 10C and the second main surface 10D are maintained in the state where the first main surface 10C and the second main surface 10D align with the vertical direction. In other words, the flat plate member 10 can be prevented from falling down by the temporarily supporting members 21. The second die 12 is then arranged, and the flat plate member 10 is thus arranged between the first die 11 and the second die 12 as in the first embodiment. The flat plate member 10 can be stably supported by using the temporarily supporting members 21 so as not to fall down even before the flat plate member 10 is arranged between the first die 11 and the second die 12 in this way according to the second embodiment.

Third Embodiment

Figure 6:
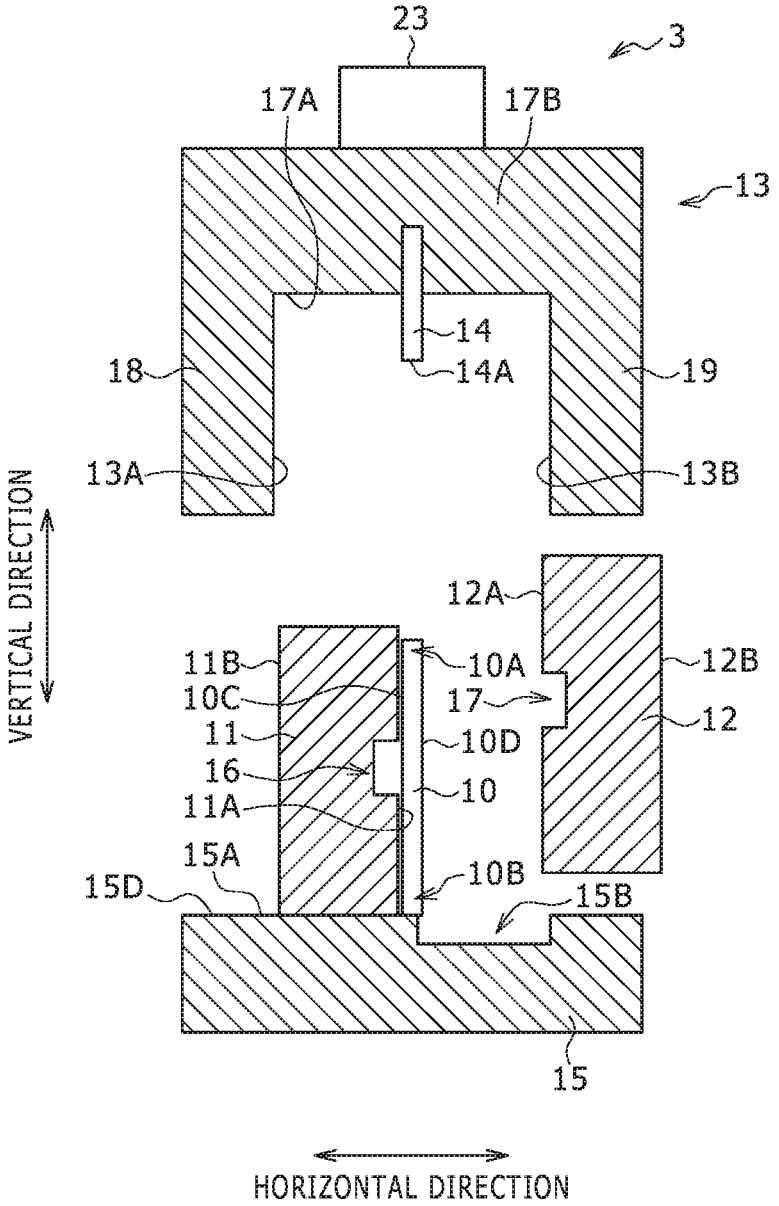
FIG. 6 is a diagram showing the configuration of a press forming apparatus according to a third embodiment of the present invention.
Figure 7:
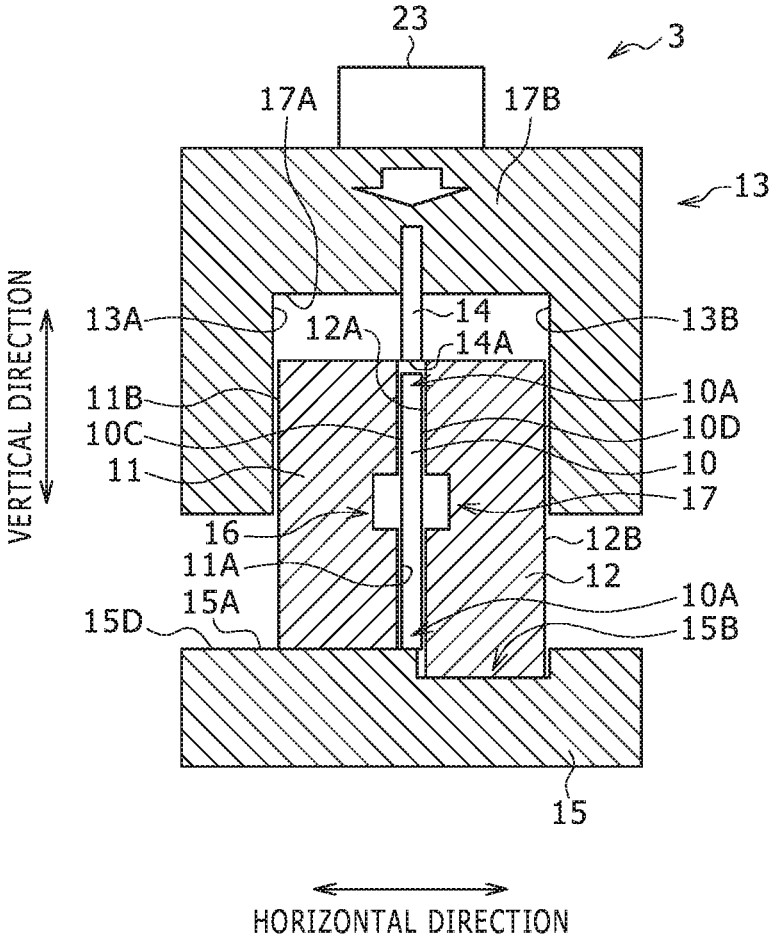
FIG. 7 is a diagram describing the manufacturing method of press-formed article according to the third embodiment of the present invention.
Figure 8:
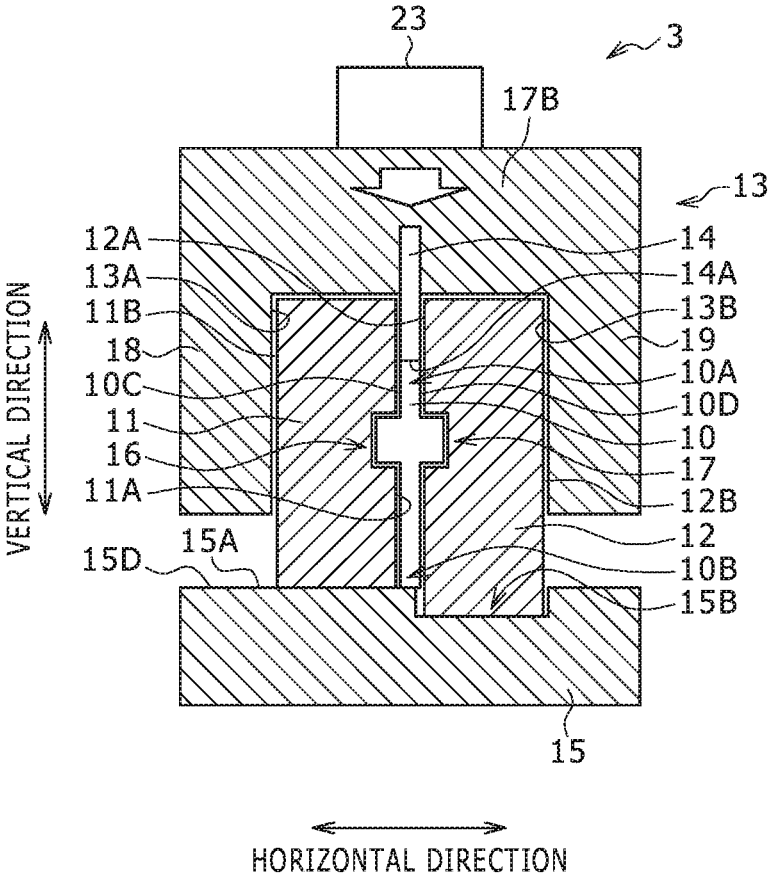
FIG. 8 is a diagram describing the manufacturing method of press-formed article according to the third embodiment of the present invention.

A description is now given of a press forming apparatus 3 and a manufacturing method of press-formed article according to a third embodiment of the present invention with reference to FIGS. 6 to 8. The press forming apparatus 3 according to the third embodiment has the same configuration as that of the press forming apparatus 1 according to the first embodiment, and provides the same effect, but is different in a point that thickened portion-forming sections 16 and 17 are respectively formed both on the first opposing surface 11A and the second opposing surface 12A.

The first thickened portion-forming section 16 is formed approximately at the center in the vertical direction on the first opposing surface 11A, and the second thickened portion-forming section 17 is formed on the second opposing surface 12A in the press forming apparatus 3 as shown in FIGS. 6 to 8. The first thickened portion-forming section 16 and the second thickened portion-forming section 17 have groove shapes in approximately the same size, and are formed at positions at approximately the same heights. It should be noted that the first thickened portion-forming section 16 and the second thickened portion-forming section 17 may have shapes different from each other, may be formed at heights different from each other, and can be appropriately designed depending on the shapes of a target press-formed article.

In the manufacturing method using the press forming apparatus 3, a part of the material of the flat plate member 10 in the vertical direction can be caused to flow into both the first thickened portion-forming section 16 and the second thickened portion-forming section 17 by using the first press portion 14A and the second press portion 15A to press the flat plate member 10 as shown in FIGS. 7 and 8. As a result, the thickened portions, which are the thick portions, of the flat plate member 10 can be formed both on the first main surface 10C and the second main surface 10D of the flat plate member 10. Manufacturing of a press-formed article in the complex shape in which the thickened portions are formed on both the main surfaces 10C and 10D can be handled by forming the thickened portion-forming sections 16 and 17 both on the first die 11 and the second die 12 in this way. It should be noted that the temporarily supporting members 21 according to the second embodiment may be used also in the third embodiment.

Other Embodiments

Finally, a description is given of other embodiments of the present invention.

Figure 9:
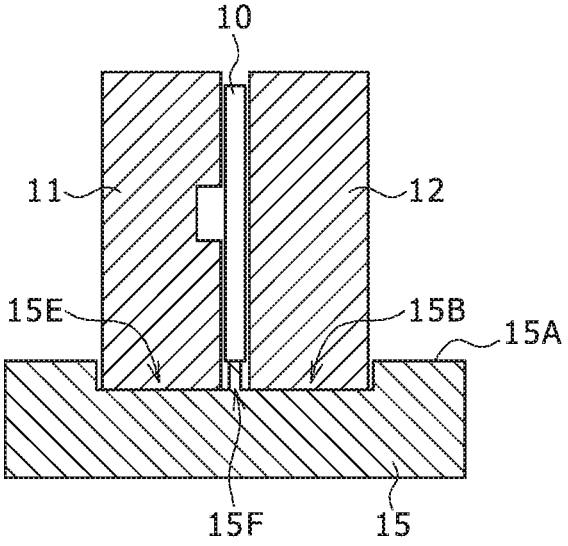
FIG. 9 is a diagram showing the configuration of a press forming apparatus according to another embodiment of the present invention.

In addition to the recess 15B in which the bottom end of the second die 12 is placed, a recess 15E in which the bottom end of the first die 11 is positioned may be formed so that the recesses 15B and 15E flank a wall portion 15F on the mount surface 15A of the support member 15 as illustrated in FIG. 9. As a result, the first die 11 as well as the second die 12 can be easily positioned.

Figure 10:
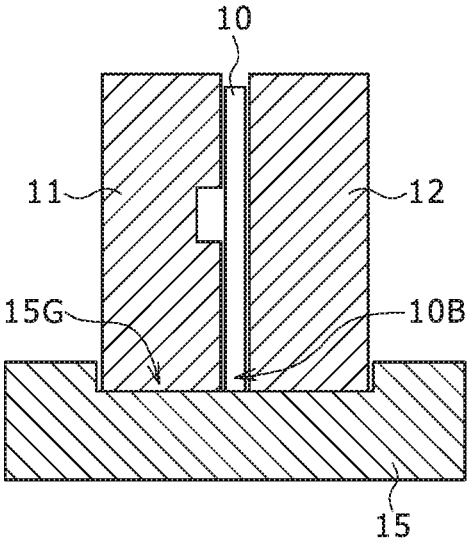
FIG. 10 is a diagram showing the configuration of a press forming apparatus according to another embodiment of the present invention.

Moreover, a recess 15G wider than an area in which the bottom end of the first die 11 and the bottom end of the second die 12 are placed may be formed as shown in FIG. 10. In this case, the second end 10B of the flat plate member 10 is in contact with a bottom wall surface of the recess 15G. Moreover, the recess itself may be omitted on the mount surface 15A.

Figure 11:
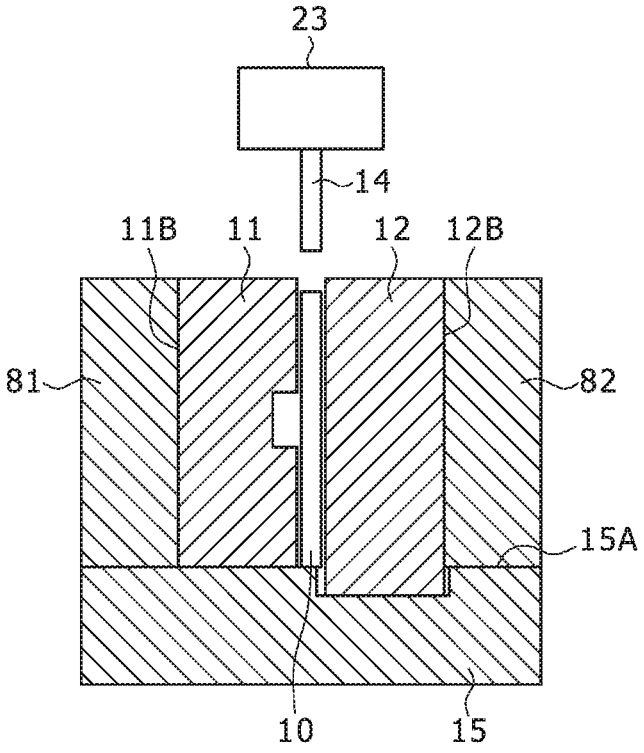
FIG. 11 is a diagram showing the configuration of a press forming apparatus according to another embodiment of the present invention.

Moreover, the supporting member and the press member 14 may be constructed individually in the press forming apparatuses 1 to 3. A first supporting member 81 is arranged so as to be in contact with the first side surface 11B of the first die 11, and a second supporting member 82 is arranged so as to be in contact with the second side surface 12B of the second die 12 in this case as shown in FIG. 11. Moreover, the press member 14 is directly fixed to the driving section 23. It should be noted that the first supporting member 81 and the second supporting member 82 are connected with each other so as to be integrally formed, which is not shown in FIG. 11. Moreover, the supporting members 13, 81, and 82 may be omitted.

The first thickened portion-forming section 16 may be omitted, and only the second thickened portion-forming section 17 may be formed in the press forming apparatus 3.

Figure 12:
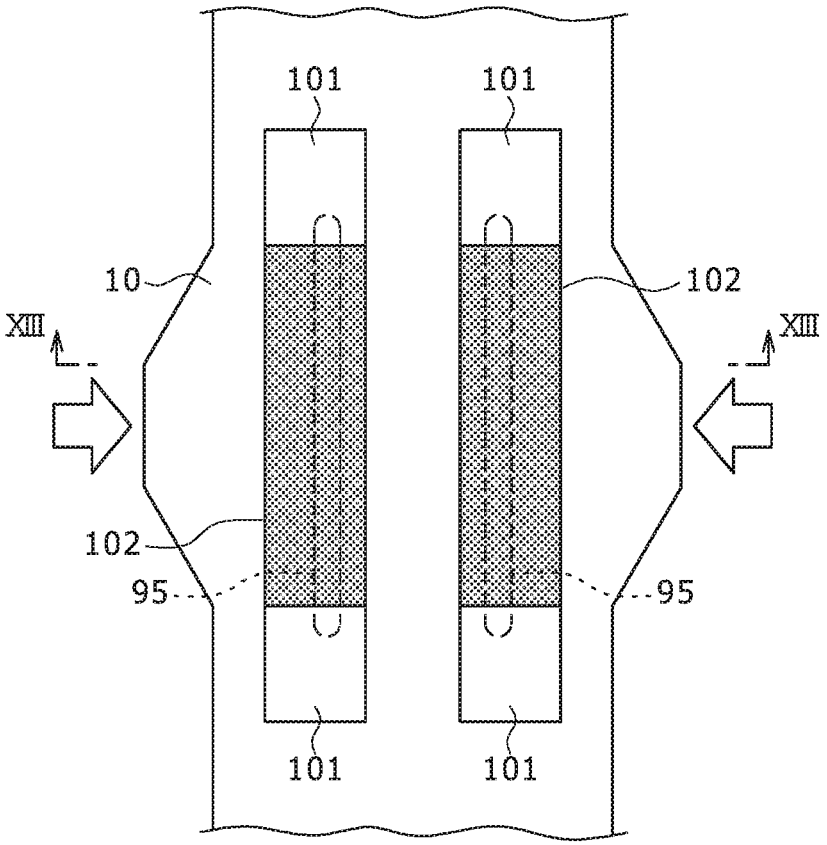
FIG. 12 is a schematic diagram describing partial electric heating.
Figure 13:
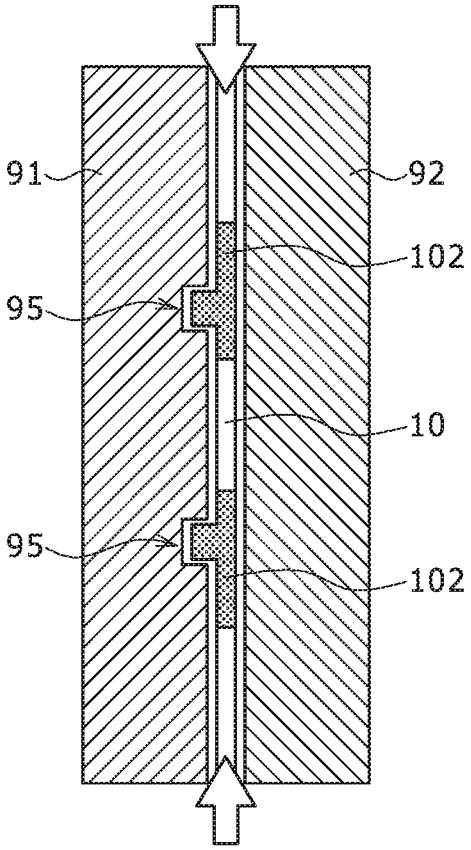
FIG. 13 is a schematic diagram describing press forming of a flat plate member to which the partial electric heating is applied.

The above-mentioned manufacturing method is not limited to the case where the entire flat plate member 10 is heated in the electric furnace, and multiple electrodes 101 may be arranged at an interval on the main surface of the flat plate member 10, and temperature rising portion by heating 102 may be partially formed by supplying a current to the electrodes 101 as shown in FIG. 12 (partial electric heating). Then, as shown in FIG. 13, the material in the temperature rising portion by heating 102 may be caused to flow into thickened portion-forming sections 95, thereby forming the thickened portion by pressing in a direction (arrow in the diagram) parallel with the main surface in a state where the flat plate member 10 is arranged between dies 91 and 92. If portions other than the temperature rising portion by heating 102 are not heated, and are maintained in a low temperature state in this way, the low temperature portions are not softened, and are maintained in a state where the strength is high, and a friction coefficient between the dies 91 and 92 and the flat plate member 10 can be reduced during the pressing. Moreover, the heating of the flat plate member 10 is not limited to partial electric heating, but the flat plate member 10 may be entirely heated by supplying a current through it.

What is claimed is:

1. A manufacturing method of press-formed article by forming a flat plate member having a first main surface and a second main surface which is directly opposite side of the first main surface in a horizontal direction, comprising:

a step of placing the flat plate member between a first die having a first opposing surface and a second die having a second opposing surface such that the first die, the second die and the flat plate member are placed side by side along the horizontal direction so that the first main surface of the flat plate member opposes the first opposing surface, and the second main surface of the flat plate member, opposes the second opposing surface; and a step of causing a first press portion opposing a first end of the flat plate member and a second press portion opposing a second end on an opposite side of the first end of the flat plate member to approach each other, thereby pressing the flat plate member, wherein:

in the step of the placing the flat plate member, the flat plate member is placed so that the first main surface and the second main surface align with a vertical direction; and in the step of pressing, the flat plate member is pressed in the vertical direction by causing the first press portion and the second press portion to approach each other in the vertical direction, and a thick portion is formed on the flat plate member by causing a part of a material of the flat plate member in the vertical direction to flow into a thickened portion-forming section formed on at least one of the first opposing surface and the second opposing surface, and wherein the step of placing the flat plate member includes:

a first placing step of placing the flat plate member so that the first main surface opposes the first opposing surface, and a second placing step of placing the second die so that the second main surface opposes the second opposing surface after the first placing step; and the flat plate member is supported by a temporarily supporting member so that the first main surface and the second main surface align with the vertical direction in the first placing step.

2. The manufacturing method of press-formed article according to claim 1, wherein at least one of the first die and the second die is arranged so that a bottom end is positioned in a recess formed on a mount surface of a support member.

3. The manufacturing method of press-formed article according to claim 1, wherein the first die and the second die are arranged so as to be positioned between portions of a supporting member in the step of pressing.

4. The manufacturing method of press-formed article according to claim 1, wherein the flat plate member is formed by means of hot press.

5. A press forming apparatus for forming a flat plate member having a first main surface and a second main surface which is directly opposite side of the first main surface in a horizontal direction, said press forming apparatus comprising:

a first press portion that opposes a first end of the flat plate member;

a second press portion that opposes a second end of the flat plate member, which is an end on an opposite side with respect to the first end of the flat plate member;

a first die that includes a first opposing surface opposing the first main surface of the flat plate member;

a second die that includes a second opposing surface opposing the second main surface of the flat plate member; and a driving section that causes the first press portion and the second press portion to approach each other in a vertical direction so as to press the flat plate member, wherein:

a thickened portion-forming section is formed on at least one of the first opposing surface and the second opposing surface so that a part of a material of the flat plate member flows into the thickened portion-forming section, thereby forming a thick portion on the flat plate member;

the first die and the second die are respectively arranged so that the first opposing surface and the second opposing surface align with the vertical direction and face each other side by side along a horizontal direction; and a support member that includes a mount surface on which the first die and the second die are placed, wherein a recess in which a bottom end of at least one of the first die and the second die is positioned is formed on the mount surface.

6. A press forming apparatus for forming a flat plate member having a first main surface and a second main surface which is directly opposite side of the first main surface in a horizontal direction, said press forming apparatus comprising:

a first press portion that opposes a first end of the flat plate member;

a second press portion that opposes a second end of the flat plate member, which is an end on an opposite side with respect to the first end of the flat plate member;

a first die that includes a first opposing surface opposing the first main surface of the flat plate member;

a second die that includes a second opposing surface opposing the second main surface of the flat plate member; and a driving section that causes the first press portion and the second press portion to approach each other in a vertical direction so as to press the flat plate member, wherein:

a thickened portion-forming section is formed on at least one of the first opposing surface and the second opposing surface so that a part of a material of the flat plate member flows into the thickened portion-forming section, thereby forming a thick portion on the flat plate member; and the first die and the second die are respectively arranged so that the first opposing surface and the second opposing surface align with the vertical direction and face each other side by side along a horizontal direction;

wherein:

the first die has a first side surface directly opposite to the first opposing surface; and the second die has a second side surface directly opposite to the second opposing surface, the press forming apparatus further comprising a supporting member that has portions positioned outside in a horizontal direction of the first side surface and the second side surface.

7. The press forming apparatus according to claim 6, comprising a press member on which the first press portion is provided, wherein the press member is integrally formed with the supporting member.

8. The press forming apparatus according to claim 6, comprising a temporarily supporting member that is attached to the support member, and supports the flat plate member so that the first main surface and the second main surface are aligned with the vertical direction.

9. A manufacturing method of press-formed article by forming a flat plate member having a first main surface and a second main surface which is directly opposite side of the first main surface in a horizontal direction, comprising:

a step of placing the flat plate member between a first die having a first opposing surface and a second die having a second opposing surface so that the first main surface of the flat plate member opposes the first opposing surface, and the second main surface of the flat plate member, opposes the second opposing surface; and a step of causing a first press portion opposing a first end of the flat plate member and a second press portion opposing a second end on an opposite side of the first end of the flat plate member to approach each other, thereby pressing the flat plate member, wherein:

in the step of the placing the flat plate member, the flat plate member is placed so that the first main surface and the second main surface align with a vertical direction; and in the step of pressing, the flat plate member is pressed in the vertical direction by causing the first press portion and the second press portion to approach each other in the vertical direction, and a thick portion is formed on the flat plate member by causing a part of a material of the flat plate member in the vertical direction to flow into a thickened portion-forming section formed on at least one of the first opposing surface and the second opposing surface, wherein the step of placing the flat plate member includes:

a first placing step of placing the flat plate member so that the first main surface opposes the first opposing surface, and a second placing step of placing the second die so that the second main surface opposes the second opposing surface after the first placing step; and the flat plate member is supported by a temporarily supporting member so that the first main surface and the second main surface align with the vertical direction in the first placing step.

10. A press forming apparatus for forming a flat plate member having a first main surface and a second main surface which is directly opposite side of the first main surface in a horizontal direction, said press forming apparatus comprising:

a first press portion that opposes a first end of the flat plate member;

a second press portion that opposes a second end of the flat plate member, which is an end on an opposite side with respect to the first end of the flat plate member;

a first die that includes a first opposing surface opposing the first main surface of the flat plate member and a first side surface directly opposite to the first opposing surface;

a second die that includes a second opposing surface opposing the second main surface of the flat plate member and a second side surface directly opposite to the second opposing surface;

a driving section that causes the first press portion and the second press portion to approach each other in a vertical direction so as to press the flat plate member, a supporting member that has portions positioned outside in a horizontal direction of the first side surface and the second side surface; and a temporarily supporting member that is attached to the support member, and supports the flat plate member so that the first main surface and the second main surface are aligned with the vertical direction;

wherein:

a thickened portion-forming section is formed on at least one of the first opposing surface and the second opposing surface so that a part of a material of the flat plate member flows into the thickened portion-forming section, thereby forming a thick portion on the flat plate member; and the first die and the second die are respectively arranged so that the first opposing surface and the second opposing surface align with the vertical direction.

* * * * *